US012416301B2

(12) United States Patent
Nolen, Jr.

(10) Patent No.: US 12,416,301 B2
(45) Date of Patent: Sep. 16, 2025

(54) TRAVELING WAVE FLUID ENERGY MACHINE

(71) Applicant: Southwest Research Institute, San Antonio, TX (US)

(72) Inventor: Craig R. Nolen, Jr., San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 183 days.

(21) Appl. No.: 18/095,555

(22) Filed: Jan. 11, 2023

(65) Prior Publication Data

US 2024/0229785 A1 Jul. 11, 2024

(51) Int. Cl.
*F04B 43/00* (2006.01)
*F04B 43/04* (2006.01)

(52) U.S. Cl.
CPC ..... *F04B 43/0054* (2013.01); *F04B 43/04* (2013.01)

(58) Field of Classification Search
CPC .. F04B 43/0054; F04B 43/04; F04B 43/0018; F04B 45/04; F04B 19/006; F04B 43/0027; F04D 33/00
USPC ..... 417/412, 436
See application file for complete search history.

(56) References Cited

U.S. PATENT DOCUMENTS 2,611,321 A * 9/1952 Shafer ..... B63H 11/06 440/15
2,888,877 A * 6/1959 Shellman ..... F04B 43/09 417/474
3,154,043 A 10/1964 Momsen
3,173,372 A * 3/1965 Baldwin ..... F04B 43/095 417/474
3,623,566 A 11/1971 Orloff
4,129,089 A 12/1978 Paidoussis
4,488,854 A * 12/1984 Miller ..... F04B 43/0018 417/241
5,192,197 A * 3/1993 Culp ..... F04B 35/04 417/322
5,820,342 A 10/1998 Au
2001/0001278 A1* 5/2001 Drevet ..... A61M 60/268 417/436
2002/0146333 A1* 10/2002 Drevet ..... F04F 7/00 417/436
2003/0021707 A1* 1/2003 Doig ..... F04B 43/14 417/413.1
2006/0159568 A1* 7/2006 Lutz ..... F04B 45/041 417/412
2008/0193307 A1* 8/2008 Elata ..... F04B 43/1223 417/474
2009/0121567 A1* 5/2009 Chou ..... F04D 33/00 310/80

(Continued)

FOREIGN PATENT DOCUMENTS

CA 2245286 3/2000

*Primary Examiner* — Mark A Laurenzi
*Assistant Examiner* — Benjamin Doyle
(74) *Attorney, Agent, or Firm* — Livingston Law Firm

(57) ABSTRACT

A fluid energy machine for imparting energy to a fluid. A channel contains a fluid flow. A flexible membrane extends the length of the channel and has a width generally corresponding to the inside width of the channel. A drive actuator at the input end of the channel imparts an activating force to the membrane at the input end of the channel, causing a transverse wave to propagate along the membrane and drive fluid through the channel.

28 Claims, 5 Drawing Sheets

(56) References Cited

U.S. PATENT DOCUMENTS

| | | | | |
|---|---|---|---|---|
| 2011/0274566 | A1* | 11/2011 | Amirouche | F04B 53/10 417/322 |
| 2013/0301218 | A1* | 11/2013 | Li | G06F 1/203 361/695 |
| 2014/0166260 | A1* | 6/2014 | Roebke | F04D 27/00 165/244 |
| 2015/0173241 | A1* | 6/2015 | Hsu | H05K 7/20209 165/104.34 |
| 2015/0285270 | A1* | 10/2015 | Buckland | F04D 33/00 92/67 |
| 2016/0338274 | A1* | 11/2016 | Messner | B05B 1/044 |
| 2017/0009787 | A1* | 1/2017 | Ito | F15D 1/06 |
| 2020/0386219 | A1* | 12/2020 | Delaisse | F04B 43/04 |
| 2021/0172429 | A1* | 6/2021 | Drevet | F04B 43/0054 |

* cited by examiner

TRAVELING WAVE FLUID ENERGY MACHINE

TECHNICAL FIELD OF THE INVENTION

This patent application relates to pumps and compressors and other machines that impart energy to a fluid, and more particularly to such devices that use traveling waves to impart energy.

BACKGROUND OF THE INVENTION

There are myriad methods of imparting useful energy to a fluid. The imparted energy may be potential energy (pressure) or kinetic energy (velocity). Some of the most common machines use positive displacement of fluid within a volume to build potential energy. Another common method is rotation of a bladed shaft or disc to impart kinetic energy.

When fluid is to be moved through a system, either a pump or a compressor is required. The term "pump" is typically used to refer to machines that move liquids or gases. The term "compressor" is typically used to refer to machines that move gases, which have a favorable ability to be compressed. Both "pumps" and "compressors" include a wide variety of devices, which in the most general terms, impart energy to fluids, by mechanical action.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

As discussed in the Background, imparting energy to fluids can be achieved by a variety of machines, including pumps, compressors, fans, and propellers. All rely on an incoming flow of fluid and impart energy to the fluid, and for purposes of this description, are referred to as "fluid energy machines".

The fluid energy machine described herein uses a sinusoidal traveling wave along a membrane to impart energy to a fluid in the wave's travel direction. The membrane is contained within a channel, and thus, the propagation of the transverse wave is capable of adding both velocity and pressure to the fluid.

As compared to other pumps and compressors, the machine described herein has fewer moving parts and points of failure than a reciprocating machine, has less exacting machining tolerances and better resistance to wear than progressive cavity or gerotor pumps, has higher pressure capabilities than peristaltic pumps, and lower material velocities than axial or centrifugal machines.

Figure 1A:
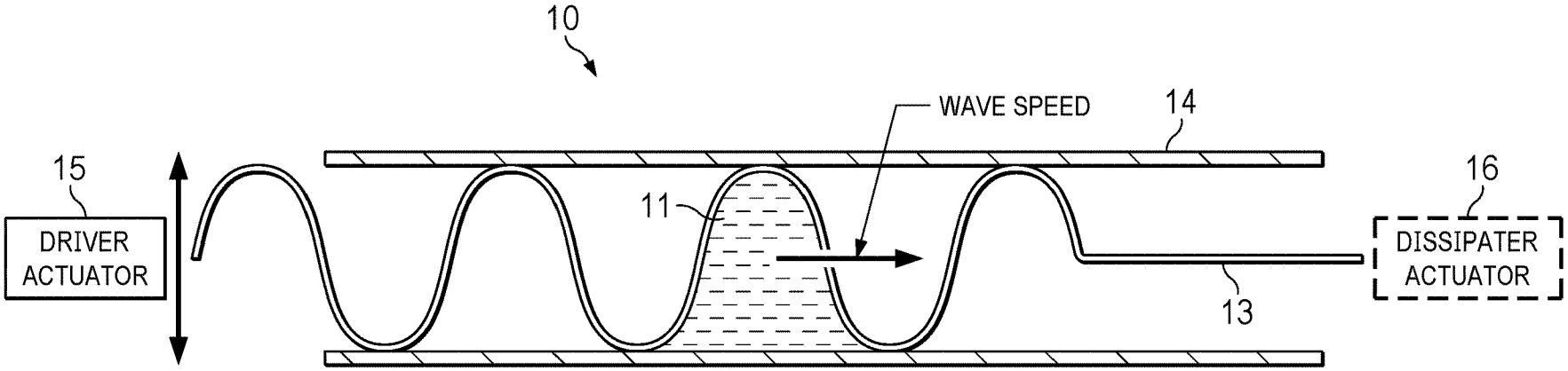
FIG. 1A is a side cut-away view of a fluid energy machine 10 in accordance with the invention.
Figure 1B:
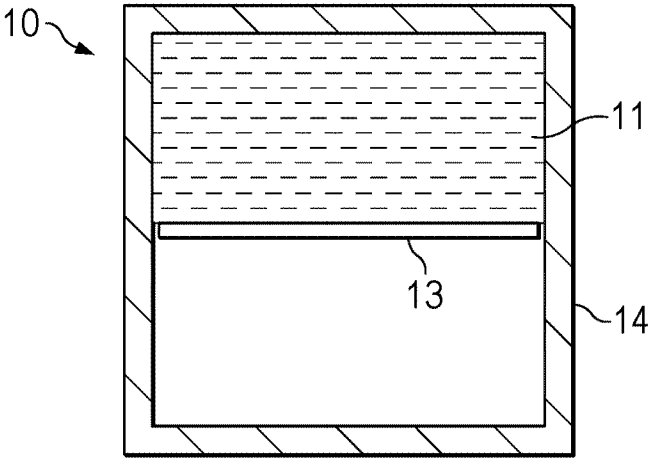
FIG. 1B is a cross-sectional view of the fluid energy machine.

FIG. 1A is a side cut-away view and FIG. 1B is a cross-sectional view of a fluid energy machine 10 in accordance with the invention. Machine 10 imparts energy to a fluid using transverse wave propagation. It adds velocity and pressure to a volume of fluid 11 contained in and moving along the length of channel 14.

Fluid energy machine 10 comprises a membrane 13 inside a channel 14, and at least one drive actuator 15. Machine 10 relies on transverse wave propagation along the length of membrane 13 to move fluid within channel 14. Using membrane 13, machine 10 causes fluid to travel in one direction along the length of membrane 13.

Channel 14 contains the working fluid and provides a transit path for a fluid flow from an input end to an output end. Channel 14 may be immersed in the fluid, or the fluid may be introduced into channel 14 at the input end.

Membrane 13 extends the length of channel 14. Some extra length of membrane 13 may be needed upstream and/or downstream of channel 14 to provide for fluid inlet and outlet. The width of membrane 13 generally corresponds to the inside width of channel 14. Membrane 13 is arranged along the center axis of channel 14.

Membrane 13 is most suitably in a thin rectangular shape, with two opposite ends held straight and pulled apart to maintain a desired degree of tension in the membrane 13. In the cross-sectional view of FIG. 1B, membrane 13 is shown in tension without actuation of a traveling wave.

Although membrane 13 is in some degree of tension from the input end of channel 14 to the output end, membrane 13 is sufficiently flexible to form a traveling transverse wave when actuated transversely at the input end of channel 14. Typically, the tension of membrane 13 is sufficient to cause membrane 13 to have a straight (not sinusoidal) shape when fluid within channel is not actuated. In the side view of FIG. 1A, the fluid within channel 14 has been "captured" in one half of the traveling sine wave resulting in fluid "packets" carried along the length of channel 14.

Membrane materials could be metal, shim-like sheets, high-strength rubber, fabric or other materials as long as fatigue limits are present and respected. Membrane thickness could vary along the direction of wave travel to influence the local wave propagation speed and hence the fluid velocity and compression.

The tension of membrane 13 may be tuned or adjusted during operation to modify the wave propagation speed. This allows for rapid changes in thrust or pressure generated, and also for fast startup.

Channel 14 is typically rectangular, but other cross-sectional geometries are possible. The walls of channel 14 may be rigid or flexible. Examples of suitable materials are thin sheet metal, plastic, rubber or others. A softer, pliable, or porous channel wall, could help reduce backward wave propagation at the channel wall and help with sealing between wavelengths.

Machine 10 has at least one driver actuator 15. In operation of machine 10, driver actuator 15 creates a transverse wave at one end of membrane 13. The wave propagates through membrane 13 at a speed depending on the tension and linear density of the membrane 13. Driver actuator 15 may be implemented with various known linear actuation mechanisms at or near the input end of channel 14.

A suitable drive actuator 15 will move membrane 13 in a continuous sine wave (or other periodic pattern) during operation. Drive actuator 15 may be operable to modulate amplitude, frequency, and/or phase of the activating force.

Drive actuator 15 may be implemented using various linear actuators (piezoelectric devices, electromagnetic coils/linear motors, hydraulic/pneumatic cylinders) or even a rotational driver with a slider-crank mechanism to convert to linear motion.

At the far end of membrane 13, the reflected wave is eliminated either by removing the wave energy with a dissipater actuator 16, or by imparting the wave's energy and momentum to a surrounding fluid. The dissipater actuator's amplitude, frequency, and phase are capable of modulation in order to eliminate or mitigate reflection of the traveling wave at the end opposite the driving actuator 15.

The dissipater actuator 16 may be driven by means similar to drive actuator 15. It may be a net consumer of load, or, as a more efficient alternative, could utilize mechanical, electromagnetic, piezoelectric, or other means to re-capture the wave's energy and feed it back to the drive actuator 15.

Applications for machine 10 are far-reaching. In general, machine 10 may be used as a replacement for various pumps and compressors. For propulsion applications, energy and momentum calculations show that a properly designed membrane could impart significant velocity to a fluid stream (potentially equal to the wave propagation speed), making use in air or underwater propulsion a possibility.

Figure 2:
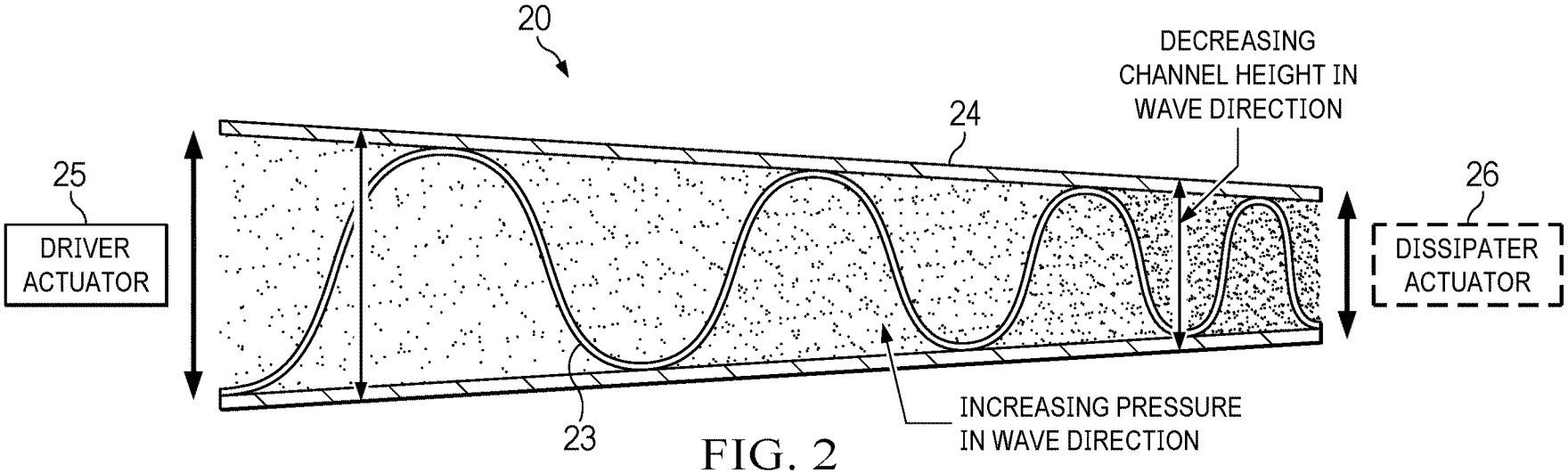
FIG. 2 is a side cut-away view of an alternate embodiment of the fluid energy machine, in which the height of the channel decreases along its length.

FIG. 2 illustrates how reducing the height of channel 24 along the direction of wave travel (a "converging" channel) could also increase pressure by reducing the volume of "trapped" packets of fluid. Increasing pressure this way could ensure the wave energy is more fully utilized before it reaches the dissipater actuator 26, reducing the amount of work required by the dissipater actuator 26 to maintain the traveling wave.

For the embodiment of FIG. 2, channel 24 could be a straight converging v-shape or could follow a smooth curve, depending on the required performance. If channel 24 is rectangular, this would be a decrease in transverse height along the length of the channel. If channel 24 is some other shape, this in general, would be a decrease in the cross-sectional area along its length.

Figure 3:
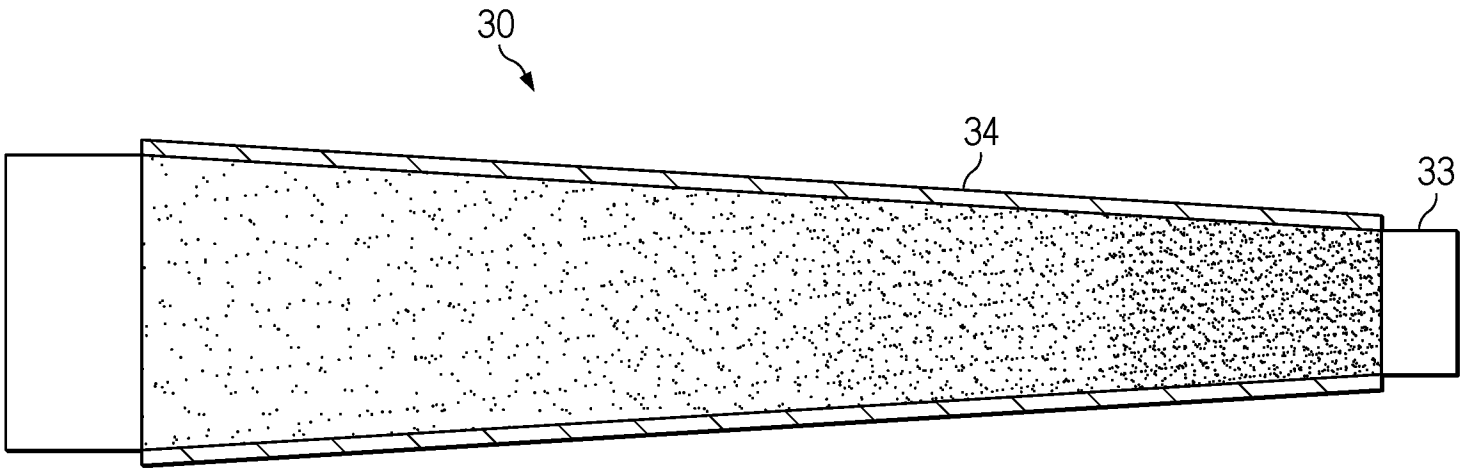
FIG. 3 is a top view of a fluid energy machine having a channel that decreases along its length in both its height and width dimensions.

FIG. 3 is a top view of a fluid energy machine 30 having a channel 34 that decreases along its length in both its height and width dimensions. In other words, like the channel of fluid energy machine 20, channel 34 has a height (y-direction) that decreases along the channel length (x-direction). In addition, channel 34 has a width (z-direction) that decreases along its length. As in other embodiments, actuation and dissipation of membrane 33 are in the y-direction.

In the embodiments of both FIGS. 2 and 3, channel convergence could be varied during operation to accommodate different operational conditions.

Figure 4:
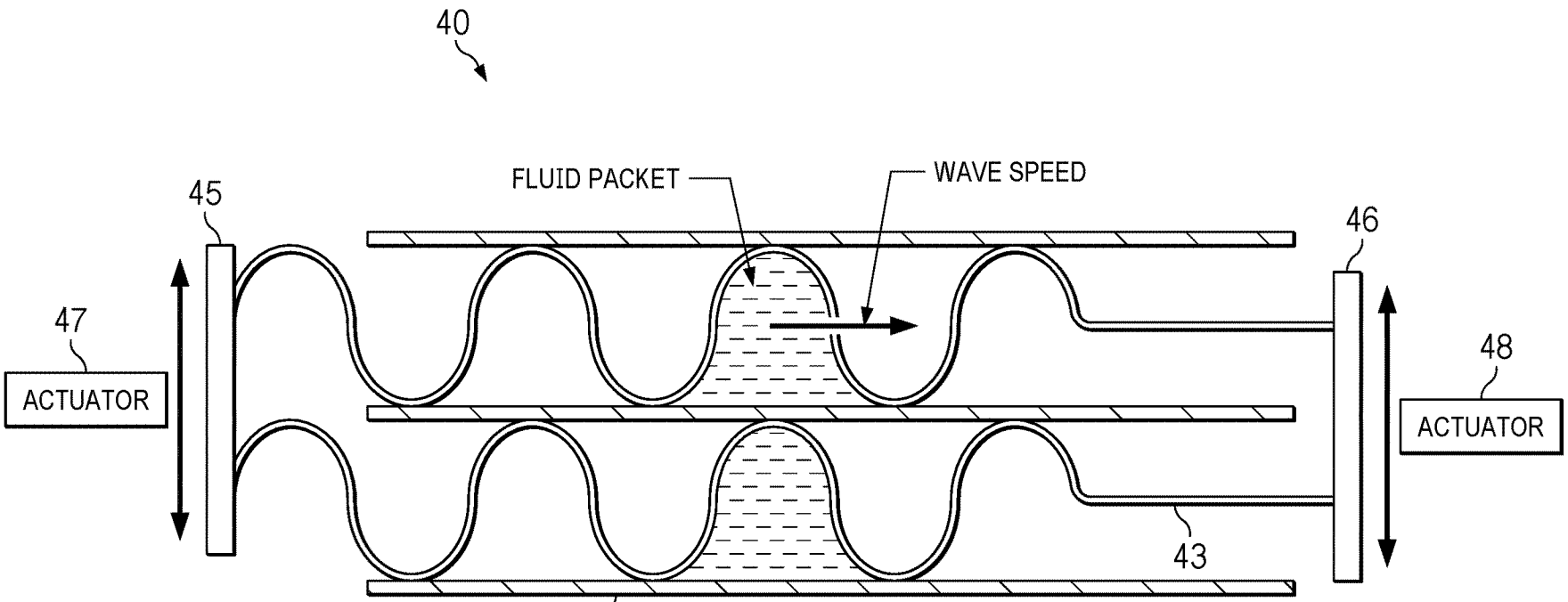
FIG. 4 illustrates a fluid energy machine having multiple parallel channels.

FIG. 4 illustrates a fluid energy machine 40 implemented with multiple parallel channels 44 to increase flow capacity. Adjacent channels 44 may share a channel wall. Each channel 44 has a membrane 43 configured and operable as described above. Membranes 43 are physically linked at both the input end and output end of channels 44, using linkages 45 and 46. Driver actuator 47 and dissipator actuator 48 are implemented as described above, except that they act on membrane linkages so that membranes are actuated and their energy dissipated in a synchronous manner.

Channels could also be arranged in series with diffusers in between to increase pressure ratio and/or convert kinetic energy into potential energy, in a manner analogous to a centrifugal compressor or pump.

Figure 5:
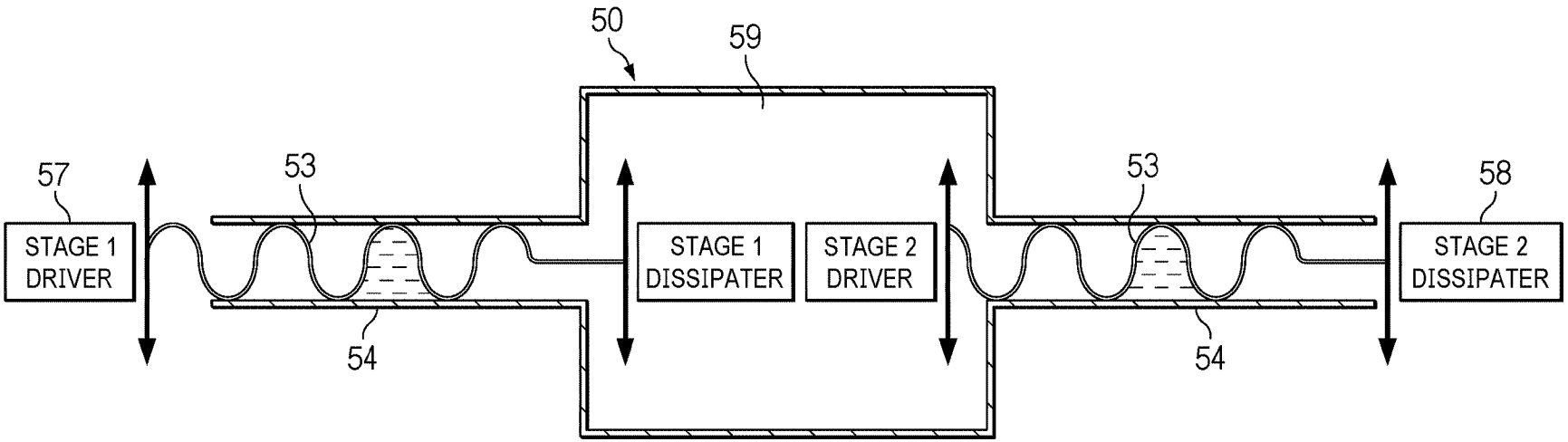
FIG. 5 illustrates a first embodiment of a fluid energy machine having multiple channels arranged in series.

FIG. 5 illustrates a first embodiment of a fluid energy machine 50 having multiple channels 54 arranged in series. This embodiment may be considered as having stages, with each channel and its membrane comprising one stage. A diffuser cavity 59 separates stages. In the example of FIG. 5, only two stages are shown but more may be used.

Each stage is driven by a drive actuator 57 and has a dissipator actuator 58, which may be implemented and operate as described above. However, between stages, the the dissipator actuator of the previous stage and the drive actuator of the next stage are contained with the diffuser cavity 59.

Figure 6:
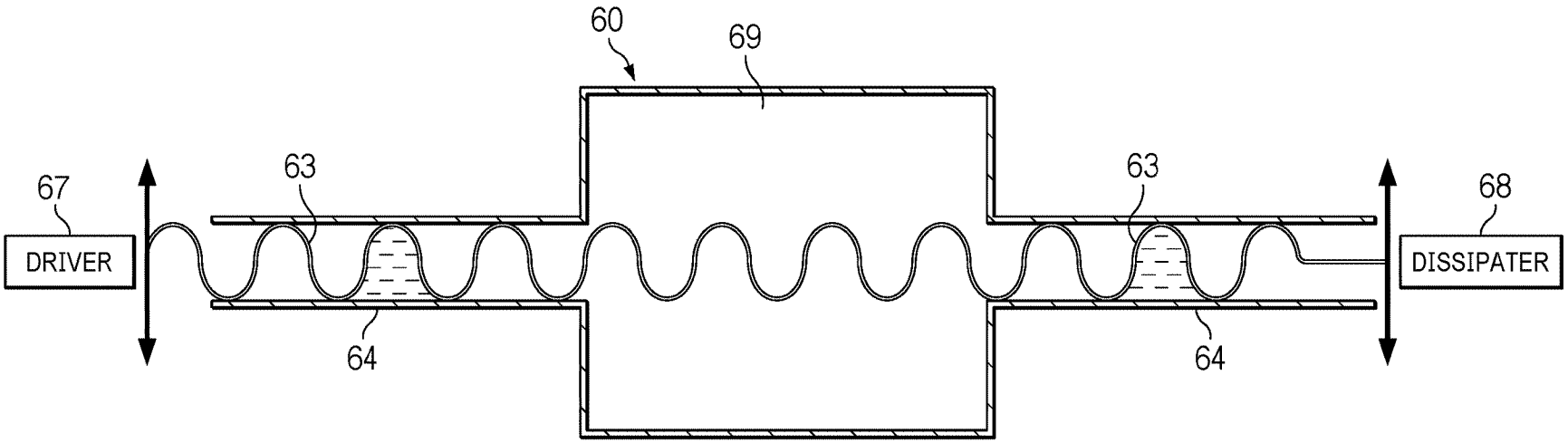
FIG. 6 illustrates a second embodiment of a fluid energy machine having multiple channels arranged in series.

FIG. 6 illustrates a second embodiment of a fluid energy machine 60 having channels 64 arranged in series. A diffuser cavity 69 separates channels 64. A single membrane 63 extends through a first channel 64, through diffuser cavity 69, and down the length of the second channel 64. In the example of FIG. 6, only two stages are shown but more may be used, with a diffusor cavity between channels.

Fluid energy machine 60 is driven by drive actuator 67 at the input end of the first channel. A dissipator actuator 68, is at the output end of the last channel. Driver actuator 67 and dissipator actuator 68 may be implemented and operate as described above.

Fluid energy machine has a number of advantages as compared to other pumps and compressors. The lack of rotating parts provides increased safety as compared to high-speed turbomachines used in aviation and power production. The lack of blade pass frequencies could also reduce noise in air or subsea propulsion. The simplicity of the components (sheet metal, membranes, linear actuators, etc.) and potential modularity could provide cost savings. In use as a positive-displacement machine, it could also find use in multi-phase flow applications. A fluid energy machine could be implemented at micro-scales using piezoelectric actuators to move or compress fluids or to propel small robots.

What is claimed is:

1. A fluid energy machine for imparting energy to a fluid, comprising:

a channel for containing a fluid flow from an input end to an output end;

a membrane extending the length of the channel, the membrane having a width generally corresponding to the inside width of the channel and a length generally corresponding to the length of the channel;

wherein the membrane is arranged along the center axis of the channel;

a drive actuator at the input end of the channel, operable to impart an activating force to the membrane at the input end;

wherein the membrane is sufficiently flexible such that when the membrane is actuated by the drive actuator, a transverse wave will propagate along the membrane and drive fluid through the channel; and a dissipater element at the output end configured to mitigate reflection of the transverse wave.

2. The fluid energy machine of claim 1, wherein the fluid energy machine is immersed in the fluid.

3. The fluid energy machine of claim 1, wherein the fluid is introduced into the input end of the channel.

4. The fluid energy machine of claim 1, wherein the membrane is the same thickness along its length.

5. The fluid energy machine of claim 1, wherein the thickness of the membrane varies along its length.

6. The fluid energy machine of claim 1, wherein the walls of the channel are rigid.

7. The fluid energy machine of claim 1, wherein the walls of the channel are flexible.

8. The fluid energy machine of claim 1, wherein the walls of the channel are porous.

9. The fluid energy machine of claim 1, wherein the drive actuator is implemented as one of the following: a piezoelectric linear actuator, an electromagnetic linear actuator, a hydraulic or pneumatic linear actuator, or a rotational driver having a linear actuation converter.

10. The fluid energy machine of claim 1, wherein the channel has a constant cross-sectional area down its length.

11. The fluid energy machine of claim 1, wherein at least one dimension of the cross-sectional area of the channel decreases from the input end to the output end.

12. The fluid energy machine of claim 1, wherein the drive actuator is operable to modulate an amplitude, frequency, and/or phase of the activating force.

13. A method of imparting energy to a fluid, comprising:

containing the fluid with a channel, the channel having an input end and an output end, and having a flexible membrane extending the length of the channel, the membrane having a width generally corresponding to the inside width of the channel and a length generally corresponding to the length of the channel, and the membrane being arranged along the center axis of the channel;

actuating the membrane at the input end of the channel, thereby imparting an activating force to the membrane at the input end;

such that when the membrane is actuated, a transverse wave will propagate along the membrane and drive fluid through the channel; and using a dissipater element at the output end of the channel configured to mitigate reflection of the transverse wave.

14. The method of claim 13 wherein the containing step is performed by immersing the channel within the fluid.

15. The method of claim 13 wherein the containing step is performed by introducing fluid into the channel.

16. The method of claim 13, further comprising adjusting the tension of the membrane.

17. The method of claim 13, wherein the dissipater element comprises a dissipater actuator, and modulating the actuator's amplitude, frequency, or phase to mitigate reflection of the wave.

18. The method of claim 17, wherein the dissipater actuator is operable to recover energy and feed back the energy to the drive actuator.

19. The method of claim 13, wherein the channel has a constant cross-sectional area down its length.

20. The method of claim 13, wherein the cross-sectional area of the channel decreases from the input end to the output end.

21. The method of claim 13, further comprising modulating an amplitude, frequency, and/or phase of the activating force.

22. The method of claim 13, wherein at least one dimension of the cross-sectional area of the channel decreases from the input end to the output end, and further comprising varying a channel convergence during the containing and actuating steps.

23. The fluid energy machine of claim 1, wherein the dissipater element is a dissipater actuator.

24. The fluid energy machine of claim 23, wherein the dissipater actuator is implemented as one of the following: a piezoelectric linear actuator, an electromagnetic linear actuator, a hydraulic or pneumatic linear actuator, or a rotational driver having a linear actuation converter.

25. The fluid energy machine of claim 23, wherein the dissipater actuator is operable to re-capture energy of the transverse wave.

26. The fluid energy machine of claim 23, wherein the dissipater actuator has an amplitude, frequency, or phase capable of modulation.

27. The fluid energy machine of claim 1, wherein the dissipater is implemented by imparting the energy of the transverse wave to a surrounding fluid.

28. The method of claim 13, wherein the dissipater is implemented by imparting the energy of the transverse wave to a surrounding fluid.

* * * * *